US005168602A

United States Patent [19]

Faas et al.

[11] Patent Number: 5,168,602

[45] Date of Patent: Dec. 8, 1992

[54] OPENING ROLLER HAVING INCLINED BEATER ELEMENTS FOR OPENING AND CLEANING MACHINE

[75] Inventors: Jürg Faas, Dinhard; René Schmid, Niederneunforn; Robert Demuth, Nürensdorf, all of Switzerland

[73] Assignee: Maschinenfabrik Rieter AG, Winterthur, Switzerland

[21] Appl. No.: 692,553

[22] Filed: Apr. 29, 1991

[30] Foreign Application Priority Data

Apr. 30, 1990 [CH] Switzerland ..... 01467/90

[51] Int. Cl.[5] ..... D01G 9/14

[52] U.S. Cl. ..... 19/94; 19/97

[58] Field of Search ..... 19/80 R, 85, 86, 87, 19/96, 97, 114, 90, 94

[56] References Cited

U.S. PATENT DOCUMENTS

| | | | |
|---|---|---|---|
| 777,537 | 12/1904 | Proctor | 19/80 R |
| 896,604 | 8/1908 | Woll et al. | 19/80 R |
| 1,318,215 | 10/1919 | McCoy | 19/85 X |
| 1,546,608 | 7/1925 | Sargent et al. | 19/80 R |
| 1,740,439 | 12/1929 | Setzer | 19/96 |
| 2,694,835 | 11/1954 | Sofio | 19/97 |
| 2,942,304 | 6/1960 | Huber et al. | 19/80 R |
| 3,123,866 | 3/1964 | Stewart et al. | 19/97 |
| 3,646,639 | 3/1972 | Burckhardt et al. | 19/97 |
| 3,686,714 | 8/1972 | Wirth | 19/80 R |
| 4,249,286 | 2/1981 | Stalder | 19/97 |
| 4,530,133 | 7/1985 | Stewart et al. | 19/97 |
| 4,798,046 | 1/1989 | Stauffer et al. | 19/97 X |
| 4,825,511 | 5/1989 | Stewart et al. | 19/85 |
| 4,964,196 | 10/1990 | Schmid et al. | 19/85 X |
| 5,019,110 | 5/1991 | Stauffer et al. | 19/97 X |

FOREIGN PATENT DOCUMENTS

| | | | |
|---|---|---|---|
| 0075348 | 9/1917 | Fed. Rep. of Germany | 19/97 |
| 2916438 | 10/1980 | Fed. Rep. of Germany | 19/97 |
| 0159929 | 1/1964 | U.S.S.R. | 19/97 |
| 1567661 | 5/1990 | U.S.S.R. | 19/94 |
| 0002773 | of 1859 | United Kingdom | 19/97 |
| 0180060 | 5/1922 | United Kingdom | 19/85 |
| 0278511 | 10/1927 | United Kingdom | 19/80 R |
| 1042886 | 9/1966 | United Kingdom | 19/97 |
| 2086951 | 5/1982 | United Kingdom | 19/97 |

*Primary Examiner*—Werner H. Schroeder
*Assistant Examiner*—Ismael Izaguirre
*Attorney, Agent, or Firm*—Burns, Doane, Swecker & Mathis

[57] ABSTRACT

A fiber opening and cleaning machine includes an opening roll provided with inclined beater elements. Such beater elements have a wave shaped design and are considerably less in diameter than the relatively larger diameter beater rods customarily used in such machines. The advantage of the wave shaped beater elements lies in the grasping and spiral conveying of the fiber flocks fed into the machine.

15 Claims, 4 Drawing Sheets

Fig. 1
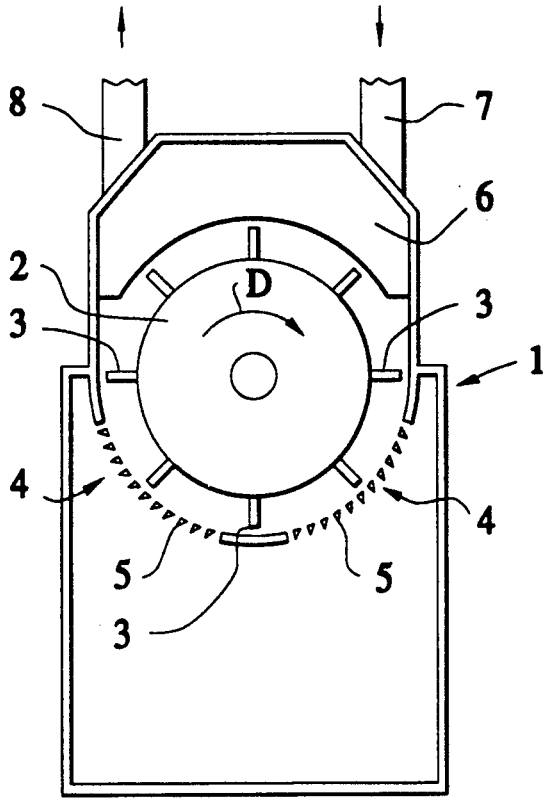
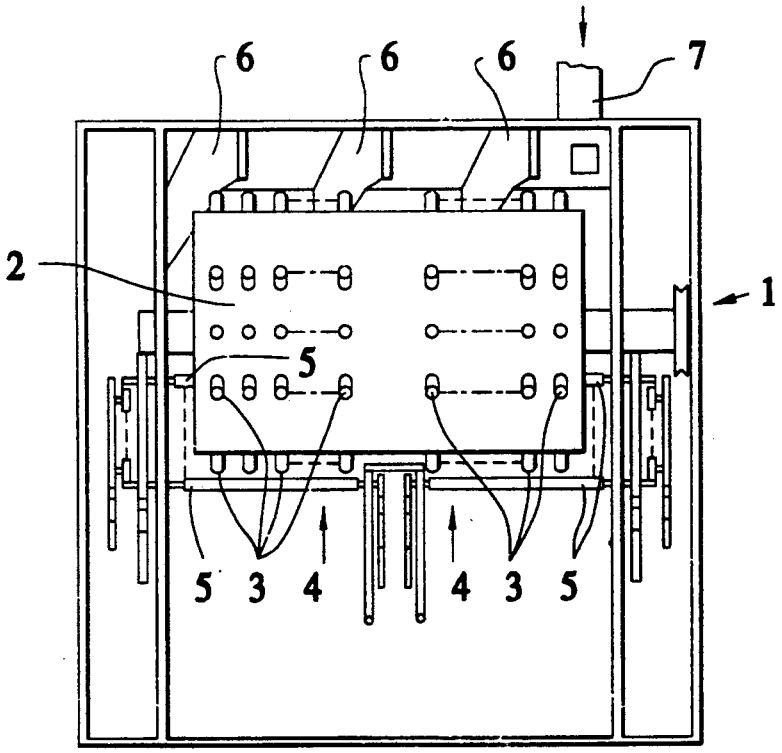
Fig. 2

OPENING ROLLER HAVING INCLINED BEATER ELEMENTS FOR OPENING AND CLEANING MACHINE

BACKGROUND OF THE INVENTION

1. Field of the Invention

The invention relates to an opening roller for a spinning mill machine for the opening and cleaning of cotton fibers. It is concerned particularly with an opening roller provided with a predetermined number of beater elements distributed on and fixed to the periphery of the opening roller for grasping and opening flocks of cotton fibers.

2. Description of Related Art

Opening rollers for so-called coarse cleaning machines are well known. For example, Maschinenfabrik Rieter AG markets such a machine under the brand name Mono Roller Cleaner B4/1. The same company has applied for letters patent in Switzerland for a further machine of this type under the number CH-00321/89-0.

These machines have beater elements distributed on the periphery of the opening roller. Such beater elements are round rods fastened radially to the periphery. They are distributed in a predetermined manner over the peripheral surface.

In these machines the fibrous material is fed toward the periphery of the roller at one axial end thereof and collected there by the beater elements. The beater elements pull the material (usually in the form of flocks over cleaning grid bars. Gradually the material is brought to the other axial end of the opening roller by means of guide chambers, where the opened fibers are conveyed through the outlet of the machine by means of centrifugal force.

The cleaning machine disclosed in Switzerland Patent Application No. CH-00321/89-0 is represented semischematically in FIGS. 1 and 2, to facilitate explanation later on of the principles of the present invention on the basis of this representation.

3. SUMMARY OF THE INVENTION

It is desirable that the opening effect of such machines be more efficient, that is to say, that the flocks be fed more efficiently with the power input remaining the same or smaller, and/or with the fiber flocks fed in being opened more efficiently and if possible, more gently. Hence, the term "more efficiently," means an increase in the opening of large fibers flocks into a plurality of smaller flocks. As far as possible according to the principle of cotton cleaning, the cleaning means primarily opens the flocks, in order to be able to remove the dirt adhering to and between the fibers more effectively.

According to the present invention, the beater elements no longer have simple surfaces directed radially to the axis of rotation of the opening roller. Rather, the beater elements according to the invention have fiber-contacting rod portions that are inclined forwardly in the direction of rotation of the opening roller surface on which they are received.

An advantage of the beater elements according to the invention lies in that the fiber flocks are thrown about less by impacts with the beater elements. Rather, they are grasped by means of the beater elements in a small part of the fiber bunch and the fiber bunch is subsequently pulled through the surrounding air as a tuft which is opened into smaller parts through the retarding tendency of the surrounding air.

For good cleaning in a machine of this type, it is desirable that the fiber bunch remain as long as possible on the beater elements and be pulled by the beater elements over the cleaning grid. That is to say, the relative speed between the fiber bunch and the beater elements should be as small as possible while the fiber bunch is being pulled over the cleaning grid.

The desired action might be likened to a kind of pinching of the fiber bunches in a way that only a small part of each fiber bunch is actually engaged by the pinching components, leaving the biggest part of the fiber bunch free to be beaten intensively by means of the grids without producing a rolling effect between the beater element and the grid bars. Rolling of the fiber bunches is disadvantageous, because rolling effects are accompanied by a danger of producing entanglement of fibers which may lead later on at least to a certain amount of neps.

The present invention provides a beater rod arrangement that functions in a manner comparable in some respects to a fiber pinching system. The fiber bunch contacting portions of the beater rods are not too thick and are arranged in a way that the bunch is kept by the rod portions over the grid bars for as long a distance as possible.

Also, the fiber bunch should come back to the beater elements after the cleaning grid, in order to be transported properly through the cleaning machine. The fiber flocks move a stage further in the axial direction of the opening roller in a transfer chamber to be described later. Subsequently they are grasped again by further beater elements, and so on stage by stage, until the fiber bunch, reduced in size and cleaned, leaves the machine on the other axial end of the opening roller.

BRIEF DESCRIPTION OF THE DRAWINGS

Exemplary embodiments of the invention are depicted in the accompanying drawings, in which FIG. 1 is a cross section through a cleaning machine according to the Swiss Patent Application No. CH-00321/89-0 with an opening roller according to the present state of technology represented semi-schematically;

FIG. 2 is another view of the cleaning machine of FIG. 1, with the opening roller being represented semi-schematically in a longitudinal section;

DESCRIPTION OF THE PREFERRED EMBODIMENTS

Figure 3:
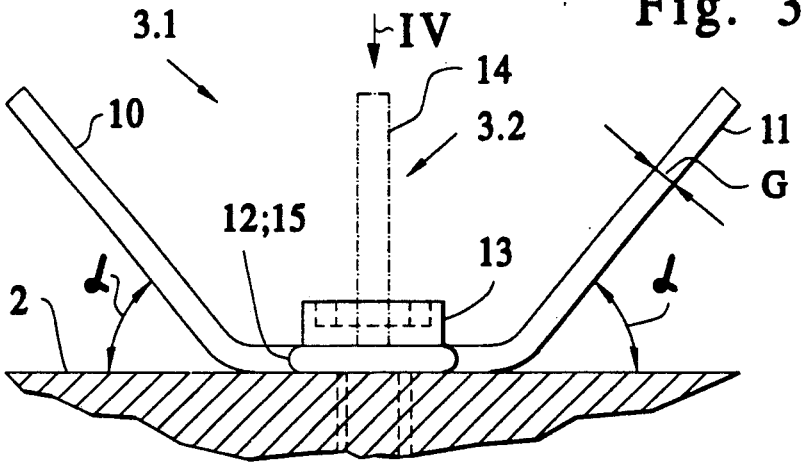
FIG. 3 is a partial section through a peripheral portion of the opening roller in a radial plane containing the longitudinal axis of the roller, with a beater element according to the invention being represented as fixed to the surface of the opening roller.

FIG. 1 shows a cleaning machine 1 provided with a rotatable opening roller 2 which can be driven. Beater elements 3 (also called "beating " elements) are distributed over the roller periphery in a predetermined manner as seen in the axial direction as well as in the radial direction. These beater elements 3 are fastened to the opening roller and extend radially with respect to the axis of rotation of the opening roller.

The cleaning machine also has a cleaning grid 4 assembled from single grid bars 5. This grid 4 is positioned opposite a part of the periphery of the opening roller, with a predetermined spacing between the tips of the beater elements 3 and the bars of the grid.

Opposite to the cleaning grid 4, the cleaning machine has chamber walls 6 above the opening roller, as seen in FIG. 1. These walls are arranged inclined to the axial direction of the opening roller, as in FIG. 2, in order to define guide chambers (not shown) through which the fibers may pass. In these guide chambers, the fiber flocks fed in are transported spirally in an axial direction as the opening roller rotates in the direction D, until the opened flocks again leave the cleaning machine through an outlet 8.

This general arrangement is present in the Mono Roller Cleaner B4/1 referred to above, which also employs beater elements like the beater elements 3 shown in FIGS. 1 and 2.

Figure 4:
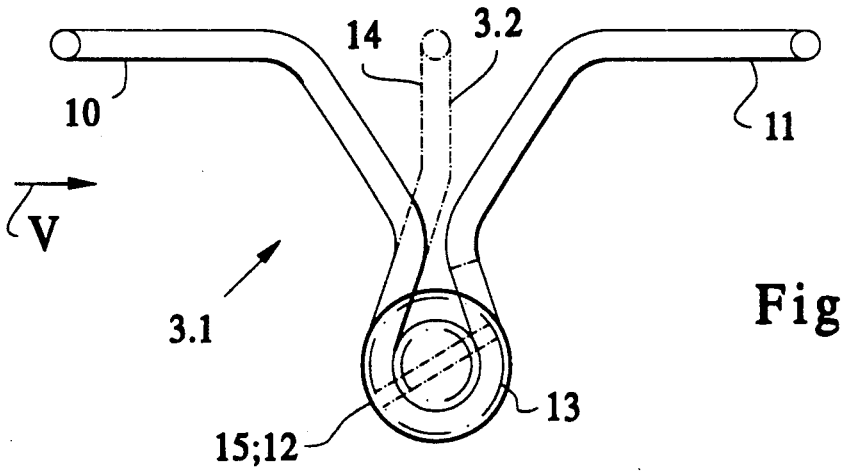
FIG. 4 is a top view in the direction IV (FIG. 3) of the beater element of FIG. 3.
Figure 5:
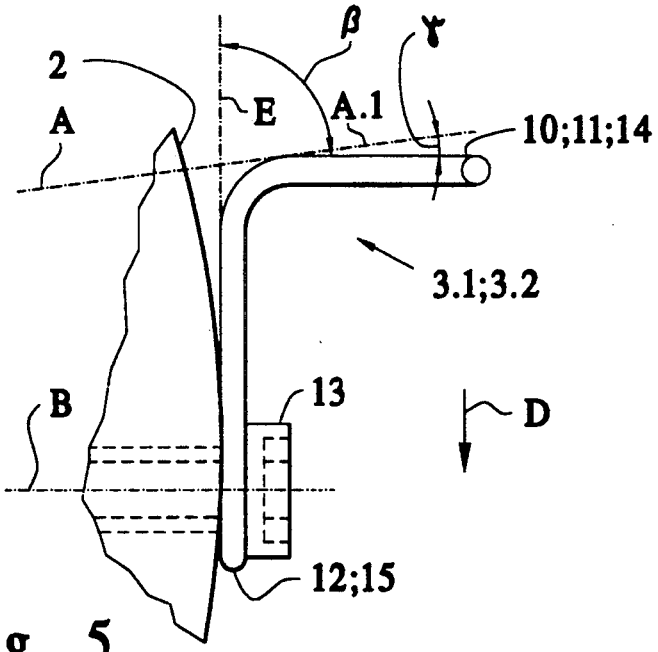
FIG. 5 is a lateral view in the direction V (FIG. 4) of the beater element of FIG. 3.

FIGS. 3-5 show a beater element 3.1 according to the invention. This beater element 3.1 includes a rod 10 and a rod 11, which together form a double hook shaped element with a fixing loop 12. The fixing loop 12 serves for fixing the beater element 3.1 on the opening roller 2 by means of a screw 13.

As can be seen from FIG. 3, each of the rods 10 and 11 has a free end portion disposed at an angle alpha opposite to the surface of the opening roller. That is, each rod 10 and 11 protrudes outwardly from the peripheral surface at an inclination substantially less than the radial protrusion characteristic of the beater elements used prior to the present invention. With the help of this oblique position, the surfaces of the beater elements are inclined relative to the surface of the opening roller as explained above, to improve their action on the fibers.

Furthermore, FIG. 3 shows that the rods 10 and 11 have a predetermined diameter G. This diameter can vary between four and eight millimeters. However, a diameter of five millimeters is preferred. A replaceable, round wire, preferably of spring steel, may be used for the production of the beater element 3.1.

It can be seen from FIG. 5 that a free end portion of each of the rods 10 and 11 has a predetermined angle beta to a tangential plane E, parallel to the axis of rotation of the opening roller. The point of tangency between the roller surface and the plane E is located at the fixing axis B of the screw 13.

The angle beta is about 90 in the example shown, so that a free end portion of each of the rods 10 and 11 opposite to a prolongation A.1 of the radius A of the cross section of the opening roller is inclined forwardly at an angle gamma in the direction of rotation D. This angle gamma is the angle between the rear face of the outer end portion of a rod and a radius A of the roller so located as to touch the trailing surface of the rod. An angle $\gamma$ of four degrees (4°) has been found to give good results. However, the selection of the angle beta, and consequently of the angle gamma, can be different, according to the size of the flocks to be cleaned and the flock material and can best be determined empirically. The same applies to the angle alpha in FIG. 3.

However, as the beater elements can be manufactured from flexible steel wire, it is a simple matter to form to the angles so as to suit the requirements in a particular instance.

In FIGS. 3 and 4, it is additionally represented with dash dotted lines, that a beater element 3.2 can have only one rod 14, instead of two. The rod 14 is shown fixed on the opening roller 2 in FIG. 4 and has angles beta and gamma, as represented with FIG. 5.

A further variant is provided when a beater element 3.1 is combined with beater element 3.2. The beater element 3.2 is arranged over the beater element 3.1 and fixed together with an appropriate extended screw 13, so that a threefold rod combination exists as shown in FIGS. 3 and 4. The end surfaces (not shown) of the rods 10, 11 and 14 must be at the same distance from the surface of the opening roller 3 and must have the same spacing from the grid bars 5.

Figure 6:
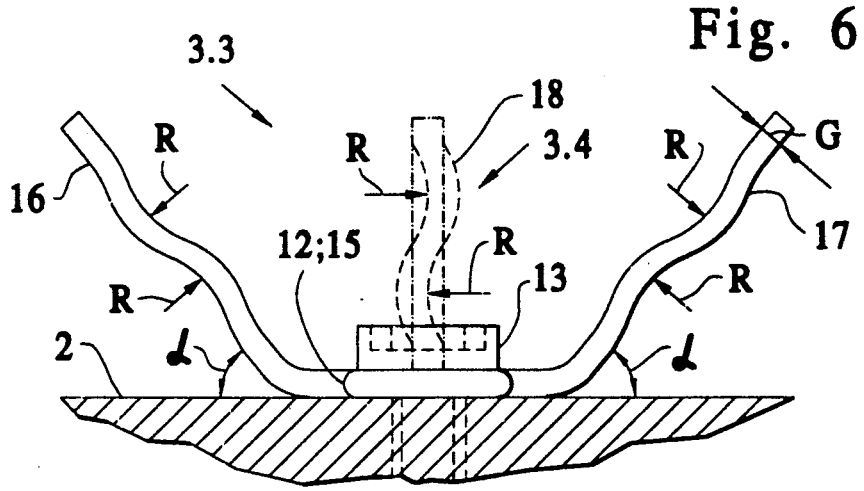
FIG. 6 is similar to FIG. 3 but showing another form of beater element in accordance with the present invention.
Figure 7:
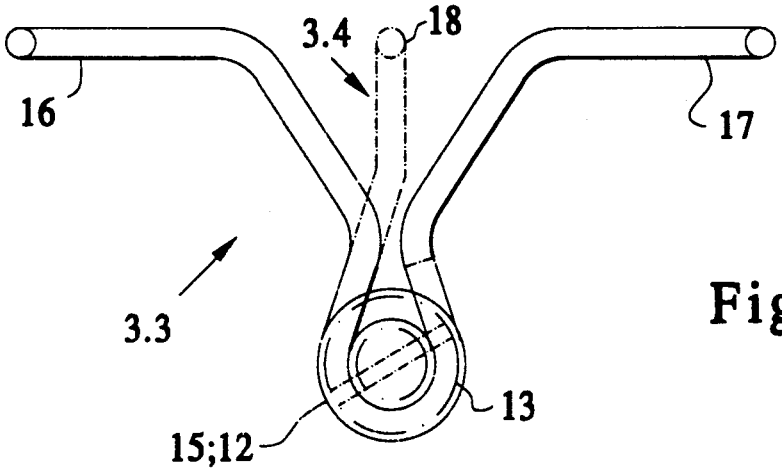
FIG. 7 is a top view similar to FIG. 4 but showing the beater element of FIG. 6.
Figure 8:
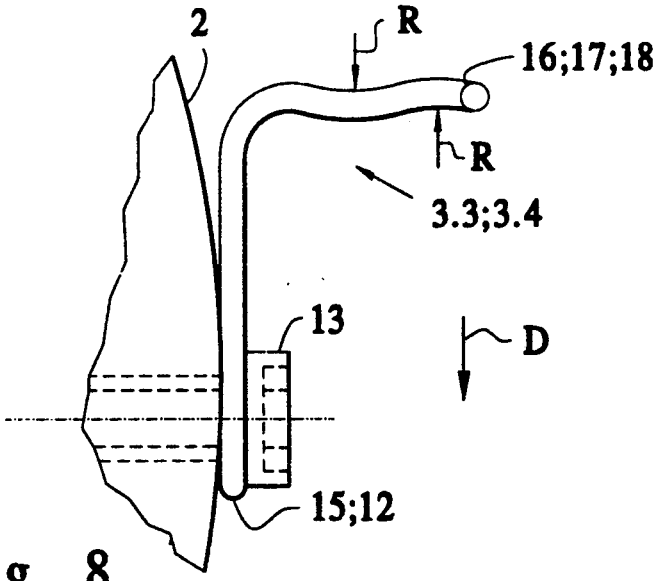
FIG. 8 is a lateral view similar to FIG. 5 but showing the beater element of FIG. 6.

FIGS. 6 to 8 show variants of the beater elements of FIGS. 3 to 5. In FIG. 6, each beater element 3.3 has rods 16 and 17 selected with the same diameter D as the rods 10 and 11 of the beater element 3.1. However, the rods 16 and 17 have outer end portions provided with a type of wave shaped bends, designated with R. The remaining parts correspond to parts of the beater elements 3.1 and they are designated with the same reference symbols.

These bends have the purpose that the fibers, which are grasped by the respective rods 16 and 17 and are gliding thereby along the bends against the free ends of the rods 16 and 17, are braked correspondingly to the bends R.

It is also represented in this variant, that a single rod 18, for example from the beater element 3.4, can be provided. This single rod also has bends R, with the same effect as with the rods 16 and 17. The beater elements 3.3 and 3.4 can be combined in the manner described above in connection with FIGS. 3 to 5.

Figure 9:
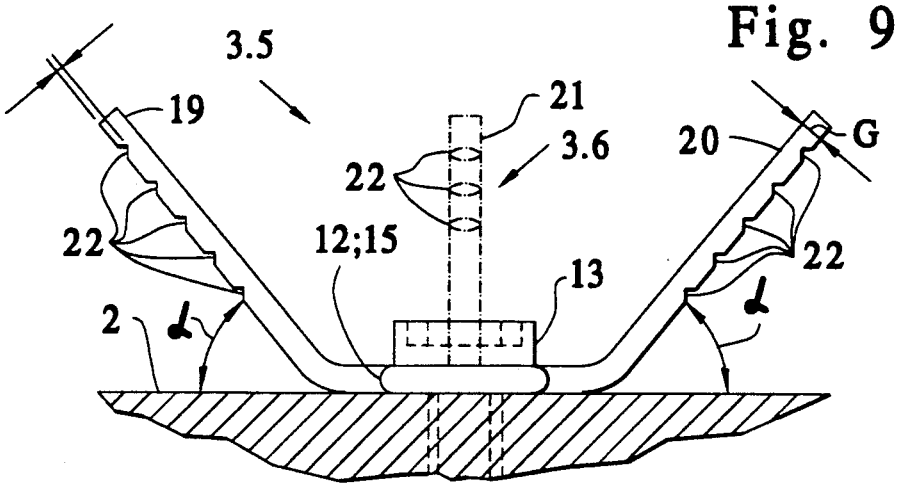
FIG. 9 is a view similar to FIG. 3 but showing another form of beater element in accordance with the present invention.
Figure 10:
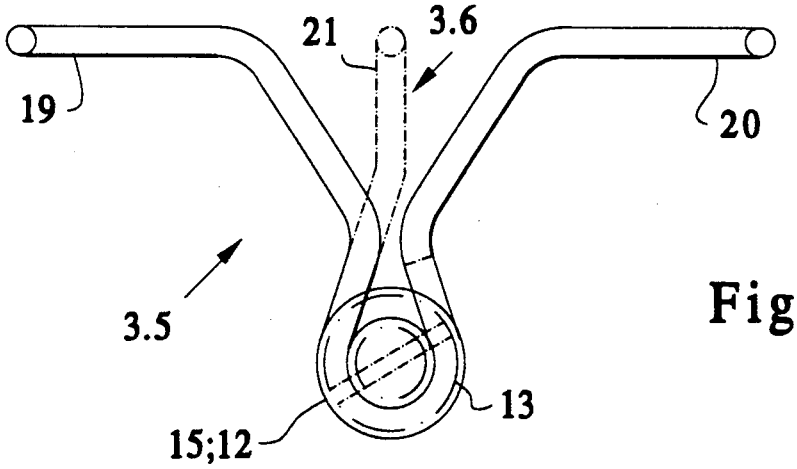
FIG. 10 is a top view similar to FIG. 4 but showing the beater element of FIG. 9.
Figure 11:
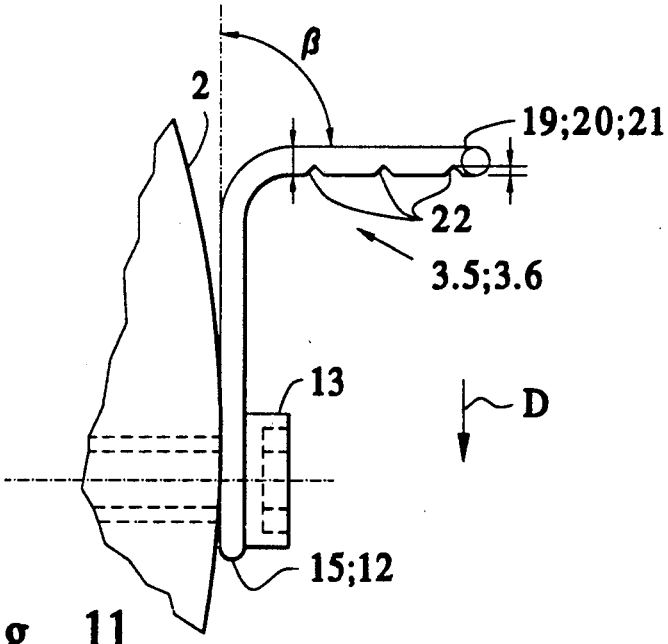
FIG. 11 is a lateral view similar to FIG. 6 but showing the beater element of FIG. 9.

FIGS. 9 to 11 depict still another form of beater element 3.5 that includes rods 19 and 20, each provided with notches which are open in the direction along the surface of the opening roller 2. The remaining parts correspond to the beater element 3.1 and are designated with the same reference symbols. A beater element 3.6 is represented as a variant of the beater element 3.2 of FIG. 5. The notches 22, as represented with FIG. 11, open in the direction of rotation D of the opening roller.

The object of these notches, as with the object of the sinusoidal shaped bends of FIG. 6, is to increase the friction between the fibers and the rods 19 and 20, for those fibers which, as described earlier for the rods 9 and 10, work their way against the free ends of the rods 19 and 20.

It is not in all instances essential that the beater elements of the present invention be formed of steel wire. Nor is it always essential that they be of a round cross section. Other materials and other profiles can be used. A profile which is more favorable aerodynamically than the round profile which is similar to the profile on the carrier flap.

Furthermore, the use of the opening roller is not limited to the cleaning machine described. The beater elements of the invention can also be used on rollers which are used in bale opening devices. The present state of technology for opening rollers in bale opening machines consists as a rule of toothed rollers, which are arranged with each other in a row to form a toothed roller body, which opens the fiber flocks from the surface of fiber bales and passes them to a pneumatic transport device.

The possibility is completely feasible in that, instead of the toothed rollers, a roller body as described is used, which is fitted to the opening roller of a bale opening device with the beater elements described.

What is claimed is:

1. In an opening and cleaning machine wherein fibers are introduced in an air steam into one end portion of a chamber, moved spirally along said chamber and removed in an air stream from an opposite end portion of said chamber and including an opening roller having beating elements projecting from a peripheral surface thereof rotating in said chamber over a grid to beat the fibers against said grid as the fibers pass spirally from said one end portion to said opposite end portion of said chamber, the improvement comprising beating elements, each having at least one rod portion inclined at an angle ($\gamma$) in a direction of rotation of said opening roller with respect to a radial line from a rotational axis of said opening roller.

2. An opening roller according to claim 1, wherein said beating element comprises a flexible wire.

3. An opening roller according to claim 1, wherein said beating element comprises means for grasping a small part of a fiber bunch and opening the fiber bunch due to a retarding tendency of surrounding air when said opening roller is in operation, so that a large part of the fiber bunch is beaten intensively by said grid.

4. An opening roller according to claim 1, wherein said beating element includes a fixing loop sized to receive a screw for fastening said beating element to said opening roller.

5. An opening roller according to claim 1, wherein said rod portion includes at least one bend therein.

6. An opening roller according to claim 1, wherein said rod portion has a diameter between 4 and 8 mm.

7. An opening roller according to claim 6, wherein said rod portion has a diameter of about 5 mm.

8. An opening roller according to claim 6, wherein said angle of inclination ($\gamma$) is about 4°.

9. An opening roller according to claim 6, wherein said beating elements are formed of a deformable material.

10. An opening roller according to claim 9, wherein said beating elements are formed from round steel wire and are replaceable.

11. An opening roller according to claim 10, wherein said round steel wire is spring wire.

12. An opening roller according to claim 1, wherein each of said beating elements has two rod portions which are spread apart.

13. An opening roller according to claim 12, wherein between said two rod portions there is a third rod portion provided in a substantially vertical direction, viewed in the direction of rotation of the opening roller.

14. An opening roller according to claim 1, wherein said rod portion is wave shaped.

15. An opening roller according to claim 1, wherein said rod portion has notches on a surface thereof.

* * * * *